United States Patent [19]

Wipkink

[11] 4,232,624

[45] Nov. 11, 1980

[54] RESERVOIR STRUCTURE

[75] Inventor: Johannes Wipkink, Sassenheim, Netherlands

[73] Assignee: Ingenieursbureau Marcon (Marine Consultants) B.V., Leiden, Netherlands

[21] Appl. No.: 909,430

[22] Filed: May 25, 1978

[30] Foreign Application Priority Data

May 26, 1977 [NL] Netherlands ..... 7705823

[51] Int. Cl.[3] ..... B65D 88/54

[52] U.S. Cl. ..... 114/257; 141/35; 141/248; 137/124; 137/266; 137/590

[58] Field of Search ..... 9/8 P; 137/590, 590.5, 137/591, 592, 266, 123, 124; 405/59, 210; 141/248, 35; 220/85 A, 5 VR, 5 VS, 1 B, 5 A, 3; 166/127, 191, 277; 114/121, 122, 125, 74 R, 74 A, 74 T, 333, 256, 257

[56] References Cited

U.S. PATENT DOCUMENTS

| | | | |
|---|---|---|---|
| 597,024 | 1/1898 | Schmitz | 220/3 |
| 2,512,801 | 6/1950 | Kinney | 166/191 |
| 2,748,739 | 6/1956 | Monti | 220/1 B |
| 2,777,295 | 1/1957 | Bliss | 220/1 B |
| 2,897,837 | 8/1959 | Van Wilgen | 137/591 |
| 3,114,344 | 12/1963 | Meade | 114/125 |
| 3,247,904 | 4/1966 | Wakefield | 166/191 |
| 3,565,045 | 2/1971 | Knox | 137/592 |

*Primary Examiner*—Edward R. Kazenske
*Assistant Examiner*—D. W. Keen
*Attorney, Agent, or Firm*—Sughrue, Rothwell, Mion, Zinn and Macpeak

[57] ABSTRACT

An underwater gas/liquid reservoir 1, particularly designed to be used as a ballast/buoyancy tank in an offshore drilling platform, has a pressurized supply duct 2 for introducing gas into the reservoir to control the liquid level therein. The gas supply duct has two openings 8, 11, one near the bottom of the reservoir and the other near the top. A movable straddle packer 14 is disposed in the gas supply duct for selectively closing the bottom opening 8 so that gas is allowed to flow only through the top opening 11 of the supply duct. The packer can also be positioned to uncover the bottom opening 8 of the gas supply duct. In operation, the liquid level within the reservoir is controlled by the introduction or release of pressurized gas into or from the reservoir through the openings of the gas supply duct either to force liquid from the reservoir or to allow liquid to flow into it.

9 Claims, 5 Drawing Figures

RESERVOIR STRUCTURE

Figure 1:
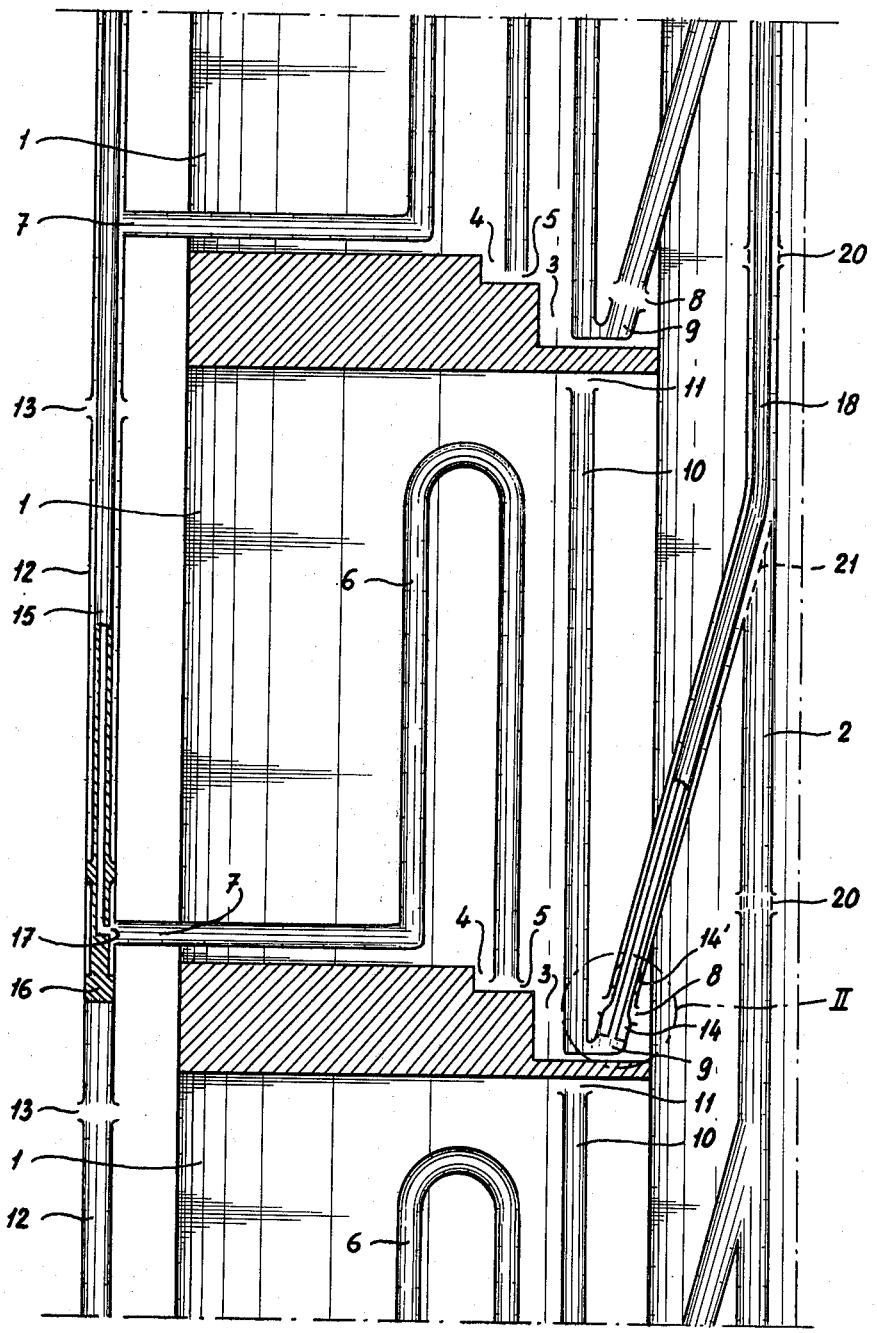

This invention relates to a reservoir structure to contain at will a gas or a liquid, with means for introducing the gas under pressure therein in such a way as to drive the liquid from the reservoir. Moreover the invention relates to a method for operating such a reservoir structure.

Primarily but not exclusively such a reservoir structure is intended for submarine use and more particularly in buoyancy tanks for submarine structures, but the invention is also applicable to reservoirs for storage purposes either below or above the earth or a water level, but more particularly for sub-sea and sub-terranean storage. The reservoir according to the invention may also be used as a ballast tank or a tank which at will is used for ballasting, for giving buoyancy and/or for storage.

Such reservoir structures, particularly for sub-terranean or sub-water use, are often not or only hardly accessible so that it is difficult to inspect parts thereof such as valves and seals and to repair, replace or operate such parts, and it is also difficult to check and repair the reservoir itself in case of leakage.

In view thereof the present invention aims at giving a reservoir structure of the type described having the least possible number of vulnerable parts, having the least possible chance that personnel will have to reach the reservoir structure or that the reservoir structure has to be replaced, e.g. brought to the surface of the water, and it is also aimed at to allow easy operation of the different parts of the structure, filling and emptying of the reservoir etc. wholly or mainly by remote control In view of the above objects a reservoir structure as given in the preamble is according to the invention characterized in that the means for introducing the gas into the reservoir include a supply duct with two openings, one near the bottom of the reservoir and one near the top, with switching means to switch from one opening to the other for introducing such gas.

Such switching means preferably include according to the invention a body to be moved through the gas supply duct to a point near the bottom of the reservoir to close the opening to feed gas to the bottom of the reservoir. In normal operation the gas may be introduced through the gas supply duct to enter the reservoir through the opening near the bottom and the switching means may in that case be entirely absent in normal operation.

More preferably the supply duct according to the invention has a branch extending in the reservoir from the bottom to the top where it opens therein, the gas being free to enter the reservoir from the supply duct through both openings when said body is removed from the said point near the bottom.

The invention also relates to reservoir structures with more than one reservoir one above the other as will be described below.

The invention also relates to a particular embodiment of the structure near the discharge opening for liquid to be driven from the reservoir by the gas under pressure and preferably such discharge opening according to the invention gives connection to a tube acting as a guiding scabbard for a body to be moved therethrough mounted on a thinner tube, said body being securable to the inside of the scabbard tube to give a sealed communication between a remote point and the reservoir through the thinner tube and the syphon tube.

The method for operating such a reservoir structure is according to the invention characterized in that the switching means in the gas supply duct are positioned to apply the opening near the top, and that liquid is thus allowed to enter the reservoir and push gas out of it through the gas supply duct until the liquid level in the tank reaches a desired level.

According to another embodiment of the method for operating such a reservoir structure according to the invention a fluid for storing in or for cleaning or coating the walls of the reservoir is introduced therein.

It is known as such to apply buoyancy tanks in submarine structures having an opening at the bottom and means to introduce gas under pressure such as air into such a tank to drive the water out. A risk in all buoyancy tanks is that by leakage or by solution of air into the water the water rises gradually in the tank. According to the invention this is avoided as fas as possible and moreover the means to counteract or correct such tendency are quite simple and reliable.

It is also known to apply such buoyancy tanks in e.g. a marine riser structure for drilling or production of minerals in numbers one above the other along a considerable height in the riser structure.

When applying the invention several parts such as valves, straddle packers, seals etc. may be used of a type known as such. Such parts are known for e.g. oil and natural gas exploration and production in many different embodiments. In order to avoid that many such parts will have to be described in much detail, we refer to known catalogues and other literature about different types of such parts, e.g. to the Composite Catalogue of Oil Field Equipment Services, edited by World Oil, Gulf Publishing Company, Houston, U.S.A., e.g. the edition of 1976/77, pages 600, 2876, 2877 and 3962.

Figure 2:
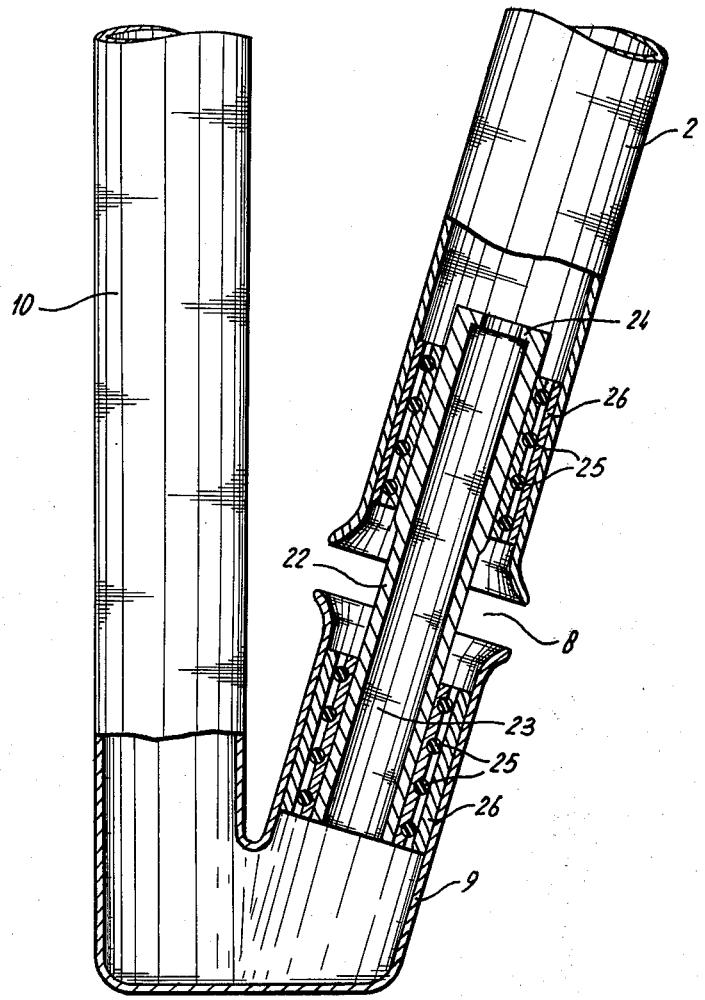
Figure 3:
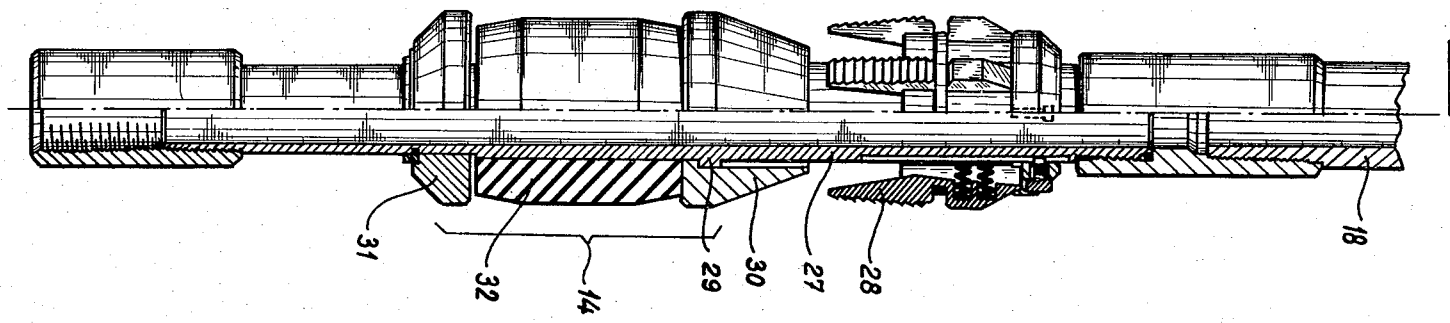
Figure 4:
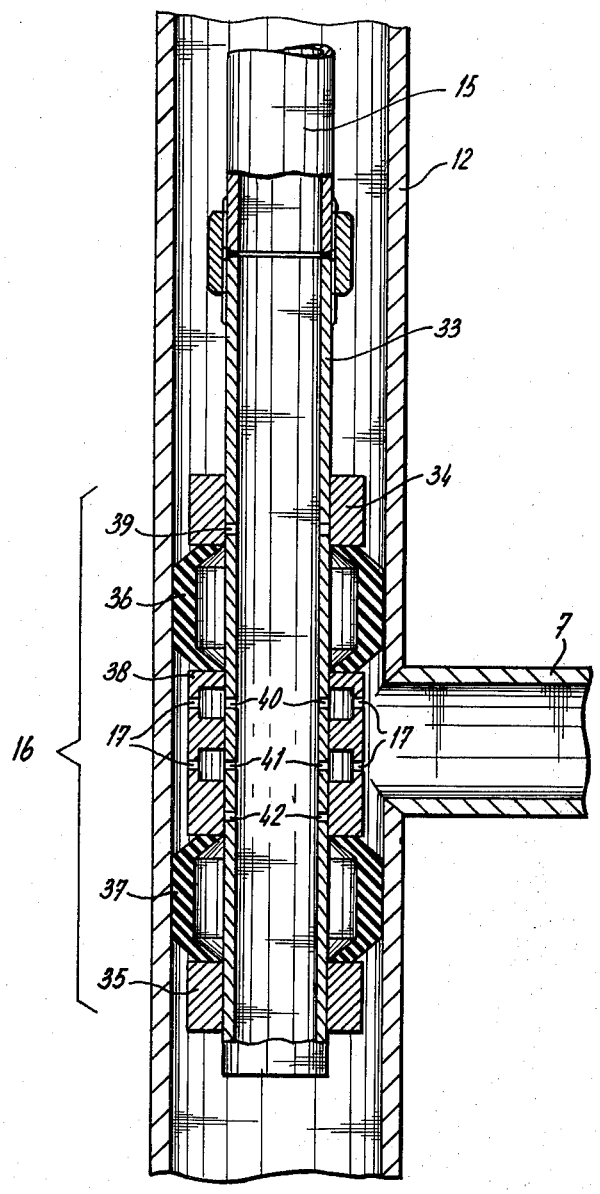
Figure 5:
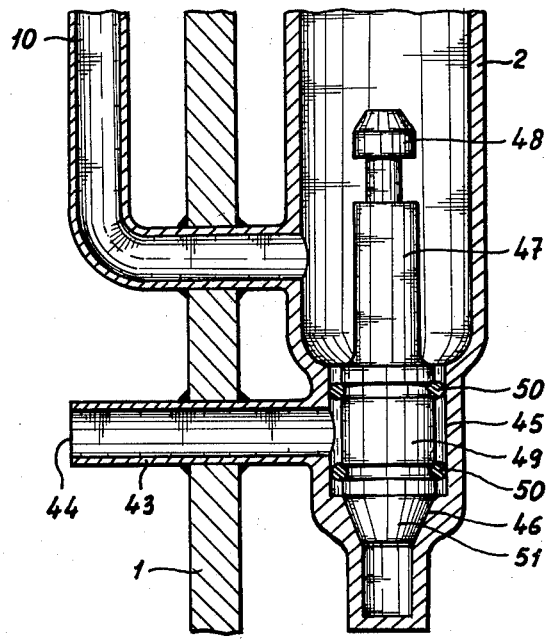

The invention will now be described in more detail with reference to the attached drawings giving for the greater part somewhat diagrammatically preferred embodiments of the structure according to the invention. In said drawings:

FIG. 1 is a diagrammatic vertical section through a submarine structure with several reservoirs for ballasting and/or buoyancy one above the other, which structure without much change is also adapted to be used for other purposes;

FIG. 2 gives a detail of the part in the dot and dash circle II in FIG. 1 at a larger scale in somewhat different embodiment;

FIG. 3 gives a so-called sealed anchor for use in such a structure according to the invention;

FIG. 4 gives a so-called straddle packer with sideways discharge for use in such a structure;

FIG. 5 gives a vertical section through a different embodiment of the parts shown in FIG. 2.

The reservoir 1 of FIG. 1 is bordered at its upper and its lower end by other reservoirs 1 and together therewith forms part of a submarine structure and in this case the reservoirs mainly are used as buoyancy tanks, but they may also be used as ballast tanks.

The water may be driven out of each tank by supplying air under pressure through a supply duct 2 and each tank 1 may have one or more of such ducts. In FIG. 1 said duct 2 is embodied as a scabbard with interruptions 20 and a switch comparable to railroad points at 21, so that said duct 2 does not guide the air itself but is adapted to take up a narrower duct or hose 18 to be described in more detail below.

Moreover each tank 1 has a deepened part 3, 4. Through an opening 5 for water near the bottom of part 4 any fluid may enter a syphon tube 6 having a discharge connection 7. Said syphon tube 6 and the deepened parts 3 and 4 have the purpose to cause only a small surface area of water to be in contact with the air notwithstanding differences in level and pressure differences in the water outside the tank, e.g. by waves. Thereby solution of air into the water is decreased so that not much gas has to be supplied regularly to the tank. The air supply duct 2 opens at 8 in the deepened part 3.

One of the advantages of such tanks is that leakage or drop of pressure in the gas supply duct 2 or in the duct 18 therein does not give the danger that the tank will be filled with water, which might cause collapse or sinking of the structure, which would be the case if said duct would open in the top of the tank, and moreover with such a structure no valve structure is necessary near the tank.

If, however, it is also desired to be able to fill such a tank by water, e.g. to use it as a ballast tank, there should be a gas discharge opening near the top of the tank. One of the objects of the invention is to make provisions therefor in a safe way so as to avoid unintentional filling of the tanks with water, all this while avoiding the use of valves. To this end the supply duct 2 at the lower end at 8 terminates opposite the end of a duct 9,10 forming a knee from the interruption at 8, extending first downwards as part 9 and then upwards as part 10 to the zone at 11 just below the ceiling of the tank. The knee in the duct 9,10 is present in the deepened part 3 of the bottom of the tank so that the interruption at 8 is positioned slightly lower than the opening 5 of the lower end of the syphon tube 6 in the deepened part 4 of the tank bottom.

If it is desired to fill the tank 1 with liquid while it is filled with gas, a seal anchor 22 or 14 such as given in more detail in FIG. 2 and 3 resp. to be described below is lowered through duct 2, until it bridges the interruption 8 and there it forms a so-called straddle packer. By now opening the duct 2 of the duct 18 to an area of lower pressure, the air is allowed to leave the tank when water is able to penetrate the tank by entering through the syphon tube 6 as will be described.

The discharge connections 7 of a number of superimposed tanks 1 are connected to one or more common ducts 12 extending vertically along the outside of such tanks and having interruptions at 13, where the interior of such ducts is in connection with the surrounding water. Usually such ducts 12 are empty, i.e. free from the parts shown therein in FIG. 1. This means that air supplied through duct 2 or duct 18 is able to push the water from the tanks through the syphon tubes 6, the connections 7, the duct 12 and the interruptions 13.

Provision of the straddle packer 14 or 22 in the interruption at 8 in ducts 2,9 and 10 as described will, if duct 2 or duct 18 is opened to an area of sufficiently low pressure, e.g. to the ambient air above the water surface, allow water to flow in the opposite direction through 13, 12, 7, 6 while pushing the air through 11, 10, 9, 14 and 2 or 18 out of the tank.

If it is desired to use the tank for instance for storage of a valuable liquid or to treat the wall with some kind of material which in liquid form or as a suspension in a liquid or in some other way is supplied and applied, e.g. a cleaning agent, a float coat or a material to seal slight leakages, it is possible to introduce a thinner duct or hose 15 in duct 12, e.g. from the water surface, which duct 15 may bridge one or more interruptions 13 and terminates at the lower end at one of the connections 7 in a straddle packer or sealing anchor 16, which may be secured into duct 12 in a sealing manner. This packer, of which one embodiment will be described in more detail with reference to FIG. 4 seals duct 15 downwardly and has a side-opening 17 giving connection to the discharge connectin 7 of the adjacent tank. It is thus possible to circulate a liquid through the tank from a ship or platform at the water surface, or to store such a liquid in the tank and to remove it later on, e.g. oil for storage or a coating liquid for treating the inner walls of the tank, which liquid may, if desired, be pumped through and into and out of the tank even back and forth if desired for treating said walls intimately. With a gas such as nitrogen it is possible to expel the liquid from the tank if the use of oxygen should be avoided.

If a difficultly accessible tank shows serious leakage, it is possible by the means described to fill it with a foamable plastic material foaming in the inside of the tank or to fill it with small foam pellets. Each tank 1 may have its own duct 2 extending without interruption e.g. from supply means for air under pressure near the water surface to the interruption 8 in the lower end of the tank, but in FIG. 1 it has been shown that duct 2 is common to a number of superimposed tanks 1 having interruptions 20 and a switch station 21. The duct 18 when introduced may pass the interruptions 20 easily, and may also pass the switch station 21 with known means, for instance by introducing a guide part for guiding duct 18 either straight on or around the corner, such guide part being introduced before the duct 18 is introduced. Dash-lines in FIG. 1 show that the duct 2 may be closed continuously to guide air under pressure or another fluid itself immediately. If this duct is continuous in this sense, there need not be any part such as a straddle packer as shown in FIG. 2 and 3 in the duct if the interruption at 8 is used to introduce the gas through said interruption. Only if the interruption has to be bridged to apply opening 11 at the top of duct 10 in the upper part of the tank, a bridging anchor should be introduced engaging sealingly in the end of duct 2 at 8 and on the other hand in the adjacent part of duct 9 as to be described in more detail below with reference to FIG. 2. If an inner duct 18 should be used it is possible to anchor this at will in and just above the opening of duct 2 at interruption 8 as shown at 14' in FIG. 1 when the interruption is used to introduce the air, or to be secured in the opening end of duct 9 as shown in FIG. 1 to use the opening 11 on top of duct 10.

In FIG. 2 a straddle packer sleeve 22 is used bridging the interruption 8 between ducts 2 and 9. In the embodiment as shown this is applicable for a duct 2 guiding the gas under pressure itself without inner duct 18. This sleeve 22 has a throughgoing passage 23 for allowing gas or liquid to pass, and an upper inwardly directed flange 24 for engaging means allowing it to be moved from a distance, e.g. from a point near the water surface, through duct 2 to be gripped, removed or loosened from such means to be left in the position of FIG. 2. The sleeve 22 has external sealing rings 25, e.g. O-rings maintained in grooves of said sleeve and sealing in ducts 2 and 9, for instance in separate, accurately machined sleeves 26 secured therein. The inner diameter of sleeve 26 in duct 9 is e.g. somewhat smaller than that of sleeve 26 in duct 2 and the corresponding outer surfaces of sleeve 22 are adapted thereto, so that also the sealing rings 25 in duct 2 are at a somewhat larger diameter than those in duct 9. Thereby it is possible to introduce and to remove sleeve 22 easily.

FIG. 3 gives a possible embodiment of the sealing terminal anchor means 14 of duct 18 in FIG. 1, which may at will be anchored in the mouth of duct 2 at interruption 8 or in the mouth of duct 9 to bridge the interruption 8. In this case the flexible duct 18 carries a long sleeve 27 having around its upper part clamping jaws or chucks 28, below them a limiting flange 29 for a pressing cone 30 and below this an anchoring and sealing ring 31. By known means giving a bayonet-like connection rotation of tube 18 can bring the jaws or chucks 28 in contact with the wall of the surrounding duct when these parts of FIG. 3 are, in the mutual position of the parts as shown, introduced through duct 2 to the desired position. If now tube 18 is pulled, the jaws 28 stay in place in contact with the wall and pressing cone 30 is moved upwardly into said jaws to make them clamp with much more force reliably in the surrounding duct. Further upward movement of tube 18 will not be able to move cone 30 upwardly. Thereby pressing ring 31 presses rubber sealing and anchoring ring 32 to the underface of cone 30 in the axial direction, so that this ring 32 will become shorter and of greater diameter, so that it clamps itself reliably and sealingly in the wall of the duct such as 2 or 9. By downward movement of tube 18 and thereafter rotation thereof it is possible to loosen and remove the structure again, also from a faraway point such as from the water surface.

For this structure it is normally necessary that there is an upward force in tube 18, which is maintained during the sealing and anchoring, so that this is also called a pull-anchor. However, similar structures are also known in which it is necessary to exert continuously a downward pressure on the anchoring means to maintain the anchoring and sealing, e.g. exerted by the weight of a string of tubes resting on the means, and there are also similar structures not needing the maintaining of pull or push to maintain the anchoring, in which for instance the operation is influenced by rotation of a part only with bayonet-like locking means. Such structures are known from the catalogue indicated above.

The lower end of sleeve 27 may be much shorter, or the tube end 9 of FIG. 2 may be longer if otherwise the length of sleeve 27 would give difficulties.

FIG. 4 gives in a somewhat simplified way anchoring means able to seal and bridge a port in a duct, which may be used as the means 16 of FIG. 1 connected to duct 15 in duct 12. In this structure a sleeve 33 is secured to duct 15, which sleeve may be closed or open at its lower end, depending on circumstances. Around it there are, axially slideable, two end rings 34 and 35, and between them, in contact with each of these rings, a rubber sealing body 36,37, and between these sealing bodies there is a hollow sleeve 38. These parts are maintained axially at the correct distance, for instance by adhesive or vulcanizing of the bodies 36 and 37 to the metal parts 34,35 and 38, with which they are in contact. Moreover, sleeve 33 may have a resting and positioning means not shown and known as such to allow relative movement of the sleeve 33 over the desired distance with respect to this combination of parts 34 to 38 incl. and to keep them in the desired positions.

The sleeve 33 has radial bores 39,40,41 and 42 and the sleeve 38 has radial bores 17. This entire structure may be lowered in a duct 12 in a mutual position of the parts in which sleeve 33 is in a lower position with respect to parts 34 to 38 than shown, so that the bores 39 and 42 open into the sealing bodies 36 and 37 respectively. It is now possible to introduce a fluid under pressure e.g. air through tube 15 and sleeve 33. This air thus flows through the bores 39 and 42 and expands said sealing bodies 36 and 37 so that they engage the inner wall of duct 12 and make a sealing grip therein. The openings 40 and 41 are in such position closed by dams of sleeve 38. By now moving duct 15 with sleeve 33 upwardly into the position of FIG. 4 the bores 39 and 42 are closed by rings 34 and 38 respectively as shown and the bores 40 and 41 are opened so that the interior of duct 15 is connected for passage of fluid to the openings 17 in sleeve 38 and thus to connection 7 of syphon tube 6 in the concerning reservoir (FIG. 1). By moving duct 15 downwardly and allowing escape of pressure from the interior thereof at the top, sealing rings 36 and 37 retract, openings 40 and 41 are closed and the entire structure may be removed upwardly from duct 12. If after a longer period the pressure within sealing rings 36 and 37 would decrease, inflation is possible by also moving duct 15 and sleeve 33 downwardly, but by now maintaining pressure therein to expand said rings 36 and 37 again.

Sleeve 33 may be open at its lower end and if desired engage another body, e.g. of a similar structure at a lower tank 1 or a number of superimposed tanks. There may also be means to open one tank 1 to the interior of duct 15 while closing the others and to switch from one superimposed tank by the other by different amounts of vertical movement of duct 15 with sleeve 33 and further structure as shown of the same type, present at connection 7 of different superimposed tanks, but in which the openings 39 to 42 are opened and closed by different amounts of axial movement.

In FIG. 5 a detail is shown being about the part surrounded by dot and dash circle II in FIG. 1, but in a different embodiment. In this case the duct 2 for supplying gas under pressure has, at its lower end to the side of a tank 1, two branches 10 and 43. 10 is again a duct, in this case passing sealingly through the wall of the tank and extending upwardly, where it opens just below the top of the tank. The branch duct 43 also penetrates the wall of the tank and opens freely therein as indicated by 44. The duct 2 terminates at its lower end in a narrower machined cylindrical portion 45, having a conical seat 46 at its lower end. A body 47 may be moved up and down through the duct 2 from the surface of the water by gripping means known to the expert engaging below the head 48 of this body. A thicker cylindrical portion 49 carries two O-rings 50 adapted to make a sealing fit in the cylindrical portion 45 of the duct to both sides of the branch duct 43. The cylindrical portion 49 has a conical protruding portion 51 at its lower end fitting in the conical seat 46.

If this body is introduced and takes up the position shown in FIG. 5, there is only an opening between the interior of duct 2 and the duct 10 to the top of the tank. If body 47 is removed by lifting it as described, both duct 10 and duct 43 are open to duct 2 to allow communication between duct 2 and the tank both at a high and at a low level. This may be used for the same purposes as the structure as described with respect to FIG. 2 and 3.

The lower end of duct 2 may be closed or may be connected to a further duct extending downwardly to another tank at a lower level and the diameters of the different parts may be such that in this case a narrower body such as 47 may be lowered to said lower tank for the same purpose. In this case there may, if desired, be a bore through the body 47 as shown to allow communication between the upper part of duct 2 and a lower tank.

It will be clear that the invention may be realised in many different ways and by different applications and uses of tanks as described.

I claim:

1. A fluid storage structure having a reservoir for containing a liquid, including means for introducing a pressurized gas into the reservoir to drive liquid from the reservoir, characterized by: the means for introducing gas into the reservoir including a gas supply duct having two openings, one near the bottom of the reservoir and one near the top, and selectively displaceable switching means for controlling the flow of gas through the openings of the supply duct, said switching means having a first position in which both openings are open and a second position in which only the top opening is open.

2. A fluid storage structure according to claim 1, wherein the switching means includes a body movable through the gas supply duct near the bottom of the reservoir to selectively close the bottom opening, thereby allowing gas only to flow through the top opening of the gas supply duct.

3. A fluid storage structure according to claim 2, wherein the supply duct has a branch extending in the reservoir from the bottom to the top where it opens therein, the gas being free to enter the reservoir from the supply duct through both openings when the body is in the first position.

4. A fluid storage structure according to claim 2, wherein the supply duct has an interruption near the bottom of the reservoir between a duct portion entering the reservoir and a duct portion extending from the bottom to the top of the reservoir, and said body is a straddle packer adapted to bridge the interruption to close the entry opening for gas into the reservoir formed by said interruption.

5. A fluid storage structure according to any one of claims 2 to 4 wherein the movable body is mounted on a flexible gas supply duct movable through a scabbard.

6. A fluid storage structure according to claim 1, wherein a syphon discharge tube for the liquid to be driven from the reservoir by the gas under pressure is connected to a tube acting as a guiding scabbard for a body to be moved therethrough mounted on a thinner tube, said body being securable to the inside of the scabbard tube to provide a sealed communication between a remote point and the reservoir through the thinner tube and the syphon tube.

7. A fluid storage structure comprising a plurality of reservoirs positioned one above the other according to claim 6, wherein the guiding scabbard tube extends vertically along the reservoirs with connections to the reservoirs at each level, the body to be secured in the scabbard tube being securable therein at each level to seal the interior of the reservoir at that level from lower parts of the scabbard tube.

8. A fluid storage structure according to claim 1, including discharge means for the liquid from the reservoir by the gas under pressure formed by a syphon tube, a lower open end thereof opening in the reservoir and the other end opening outside the reservoir.

9. A fluid storage structure according to claim 1, wherein the reservoir is a buoyancy and/or ballast tank for a marine structure in comunication with the surrounding water near its bottom.

* * * * *